US005116091A

United States Patent [19]

Swift

[11] Patent Number: 5,116,091

[45] Date of Patent: May 26, 1992

[54] LOCKING OR SECURITY SEAL WITH PROTECTIVE SHROUD

[75] Inventor: Allan W. Swift, Denville, N.J.

[73] Assignee: E. J. Brooks Co., Newark, N.J.

[21] Appl. No.: 586,429

[22] Filed: Sep. 21, 1990

[51] Int. Cl.[5] ..... E05C 10/18

[52] U.S. Cl. ..... 292/318; 292/321

[58] Field of Search ..... 292/322, 321, 320, 319, 292/318, 307 R, 307 B

[56] References Cited

U.S. PATENT DOCUMENTS

| | | | |
|---|---|---|---|
| 3,402,435 | 9/1968 | Merser | 292/321 |
| 3,881,759 | 5/1975 | Fuehrer | 292/321 |
| 4,240,183 | 12/1980 | Sumimoto et al. | 292/319 |
| 4,245,374 | 1/1981 | Suzuki | 292/321 |
| 4,500,124 | 2/1985 | Swift | 292/318 |
| 4,559,676 | 12/1985 | Paradis | 292/318 |
| 4,680,836 | 7/1987 | Wisecup | 292/322 |
| 4,697,833 | 10/1987 | Swift | 292/322 |
| 4,854,014 | 8/1989 | Ueno | 292/319 |

*Primary Examiner*—Eric K. Nicholson

*Attorney, Agent, or Firm*—John D. Kaufmann

[57] ABSTRACT

A security seal has a band mounting a protrusion at one end and a housing at the other end. The end of the protrusion may be first passed through apertures in a latch or closure and then may be inserted into, and held by gripping facilities within the housing. The portion of the protrusion extending away from the housing resides in the apertures and prevents operation of the latch or closure absent damage to or disintegration of the seal. Vibratory and oscillatory motion which occurs during shipping or handling of an item bearing the seal can cause the aperture walls to cut or saw through the protrusion, giving a false indication of tampering. A protective shroud is provided which surrounds the protrusion and is interposed between it and the apertures to prevent cutting or sawing of the protrusion.

16 Claims, 2 Drawing Sheets

LOCKING OR SECURITY SEAL WITH PROTECTIVE SHROUD

BACKGROUND OF THE INVENTION

The present invention relates to a locking or security seal, and more particularly to an improved frangible locking or security seal of the type which easily becomes disintegral if an attempt it made to tamper with or defeat the seal or to operate, open or gain access to a protected item with which the seal has been associated.

Locking or security seals generally of the same or similar type as the improved locking seal of the present invention are well known. See for example commonly assigned U.S. Pat. Nos. 3,466,077; 3,467,427; 3,830,538; 4,229,031; 4,319,776 and 4,506,921.

In a first type of prior art seal, a shackle, comprising a flexible band, is inserted through apertures formed in relatively movable members of a lock, latch, operating handle or the like. Following such insertion, the terminus of a locking portion carried at one end of the shackle is inserted into a housing carried at the other end of the shackle. The housing contains facilities which prevent the withdrawal of the locking portion terminus following its insertion. The shackle interferes with attempts to operate or open the lock, latch, operating handle or other protected item.

Determined attempts to operate or open the protected item by overcoming the shackle's interference result in the shackle or some other portion of the seal becoming disintegral. Similarly, attempts to tamper with or defeat the seal also result in its becoming disintegral. If the seal is disintegral, a visual indication is given that an attempt—successful or otherwise—has been made to affect the protected item. This visual indication leads to inspection of the item or its contents to determine what, if anything, an interloper may have achieved.

In a second type of locking or security seal, access to or operation of a protected item is prevented by inserting the locking portion rather than the shackle or flexible band through apertures in relatively movable members on or associated with the protected item. The flexible band, which serves as a shackle in seals of the aforedescribed type, serves, in this type of seal, as a carrier for the locking portion and the housing. Attempts to open, operate or otherwise affect the protected item or to tamper with or defeat the seal result in the seal becoming disintegral.

Protected items are often containers, such as barrels or crates. Depending on whether the first type or the second type of seal is used, either the shackle or the locking portion of a seal may be inserted into apertures in an appropriate container closure, such as a hasp/staple combination or the locking lever of a band assembly or lock ring which holds a lid onto a barrel. If the seal is later noted to be disintegral, the container must be inspected to see if theft, tampering or adulteration have occurred.

Containers are typically shipped or transported on trucks, trains and airplanes. In transit, the containers may be subjected to random vibration or oscillatory motion. The forces incident to such motion are applied to the containers and may cause the container closure and the seal to move relatively in such a way that the walls and edges of the apertures through which the seal extends ultimately cut, shear or "saw through" the seal. When the seal is detected to be disintegral, inspection of the container and its contents is required, since it cannot be known whether this condition was caused by the act of an interloper or by a less sinister cause, such as vibration.

A general object of the present invention is an improved locking or security seal of the second type discussed above, in which the effects of forces on the seal during shipment are prevented from rendering the seal disintegral to give a false indication of tampering.

SUMMARY OF THE INVENTION

The present invention is an improved frangible locking or security seal. In general, the seal includes a flexible band which carries at one end a housing and at the other end an elongated locking portion. The housing contains facilities which permit a terminus of the locking portion to be inserted thereinto. These same facilities prevent withdrawal of the locking portion terminus once it has been inserted. The elongated locking portion is insertable through apertures formed in the relatively movable members of a closure, which prevents entry to or operation of a protected item. Attempts to move the members of the closure, as well as attempts to defeat or tamper with the seal, result in the seal becoming visibly disintegral, which requires that the protected item be inspected for theft or tampering. Where the protected item is a container, it and the seal are subjected to vibratory and oscillatory movement and forces during shipment. These forces may cause the walls or edges of the apertures to cut, shear or "saw through" the locking portion, rendering the seal disintegral and falsely indicating that an interloper has been active. The concomitant unnecessary inspection of the container and its contents is annoying, needlessly time-consuming, and costly.

To avoid the above-described false indication, the seal includes a shroud. The shroud is carried by the housing and surrounds both the point of entry of the locking portion terminus into the housing and a substantial portion of the locking portion extending away from the housing. Thus, the shroud surrounds the locking portion and is interposed between the locking portion and the walls and edges of the apertures in the closure members. This prevents the locking portion from being cut or sheared by vibration-induced forces.

In preferred embodiments, the band, locking portion, housing and shroud are integrally formed in a plastic molding operation. The locking portion may be a pin-like member extending away from the band, and the length of the shroud is only slightly less than the distance between the band and the housing when the locking portion terminus is held in the housing. Moreover, the locking portion is preferably enlarged near its attachment to the band. The enlargement at least partially enters the shroud and thereat is spaced sufficiently close to the interior of the shroud to discourage attempts to insert objects between the locking portion and the shroud in an attempt to defeat the seal. Attempted insertion will result in fracturing the shroud or the locking portion giving a visual indication thereof. The locking portion may also be weakened at its attachment to the band to ensure that the seal becomes disintegral if it is tampered with.

In specific embodiments, the band is planar, and the locking portion, the housing and shroud all extend perpendicular away therefrom, with the locking portion and the shroud being on the same side of the band. The locking portion may have an enlarged head with a forward camming surface and a rearward shoulder. The facilities which permit insertion of the locking member and prevent its withdrawal once inserted may constitute a plurality of resilient fingers within the housing. The fingers have free ends and define there between a tapered passageway. Insertion of the enlarged head into the passageway results in the camming surface flexing the fingers outwardly so that the head may pass therethrough until the shoulder clears the free finger ends. At this time, the fingers resiliently return to their original positions and the free ends abut the shoulder to prevent withdrawal of the head from the passageway.

DETAILED DESCRIPTION

Figures 1, 4, 5:
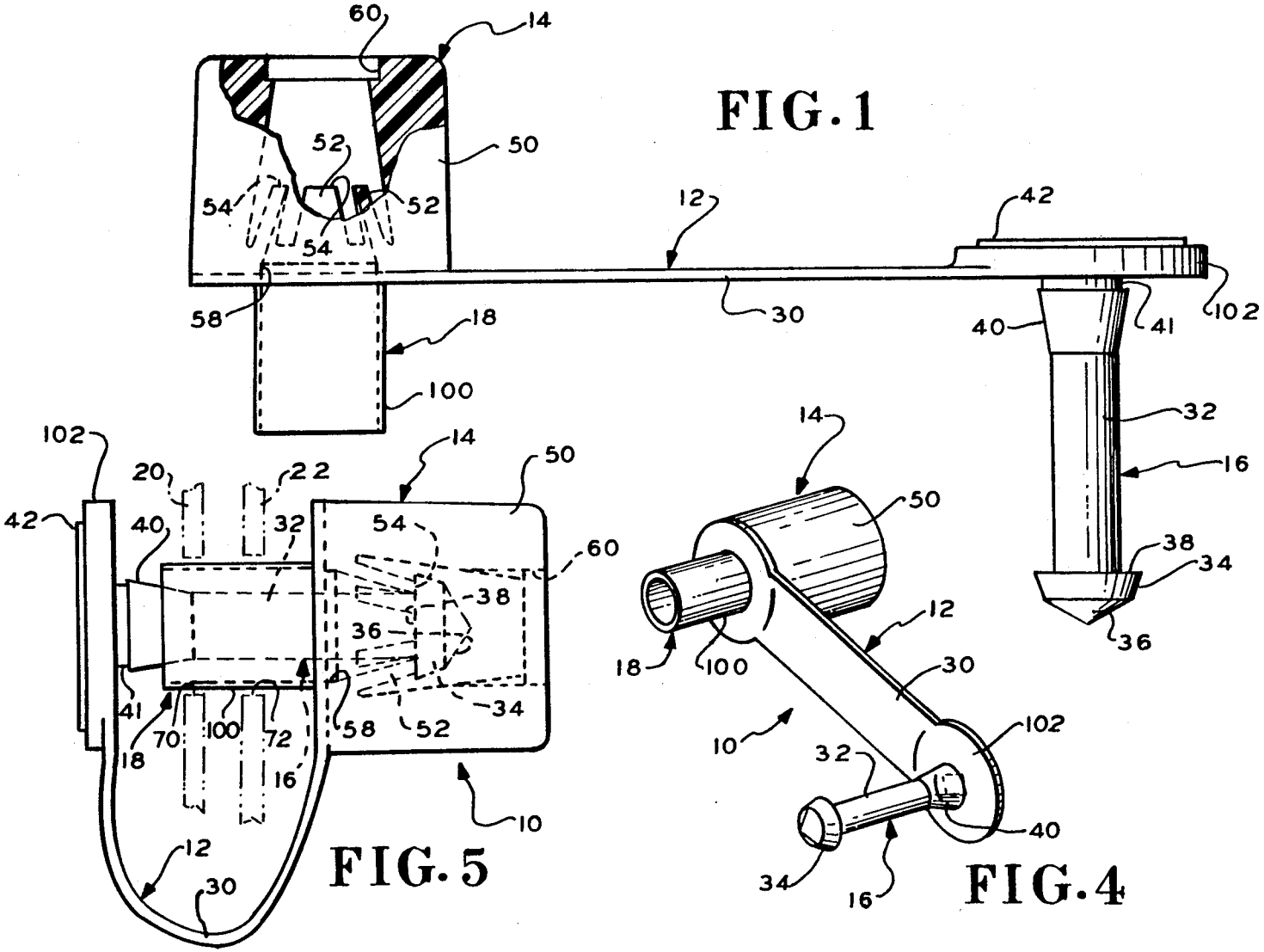
FIG. 1 is a plan view of an improved locking seal according to the present invention.
FIG. 4 is an isometric view of the locking seal depicted in FIGS. 1-3.
FIG. 5 is a plan view of the locking seal shown in FIGS. 1-4 after its parts have been associated in such a way as to permit the seal to perform its protective function.

Referring to FIGS. 1-4, there is shown a locking or security seal 10 according to the present invention. The main elements of the seal 10 are a band 12, a housing 14, a locking portion 16 and a shroud 18. Except for the shroud 18, which, as depicted in the Figures, constitutes a species of the generic improvement of the present invention, the elements 12, 14 and 16 are generally known.

Referring briefly to FIG. 5, the seal 10 is frangible and is, in specific use environments, intended to give a visual indication of an unauthorized attempt to relatively move the operating members 20 and 22 of a container closure, such as a band assembly or lock ring (not shown) which holds a cover (not shown) on a shipping container, such as a barrel (not shown). Any attempt to move the members 20 and 22 while the seal 10 is in place, as well as an attempt to tamper with or defeat the seal 10, results in the seal 10 becoming disintegral. Visual detection of such disintegrity results in inspection of the container and its contents. If the seal 10 becomes disintegral for reasons other than the acts of an interloper, the resulting unnecessary inspection needlessly wastes time and money.

Referring to FIGS. 1-4, the band 12 comprises an elongated, flexible, thin, frangible, planar member 30, made, for example, of molded polypropylene or nylon and being about 0.02 inch thick. Any material may be used which is conveniently moldable and which may be formed into a fragile, frangible seal 10 which fractures, breaks or otherwise becomes disintegral upon the application thereto of low to moderate forces incident to an attempt to move the members 20 and 22 or to tamper with or defeat the seal 10.

Figure 2:
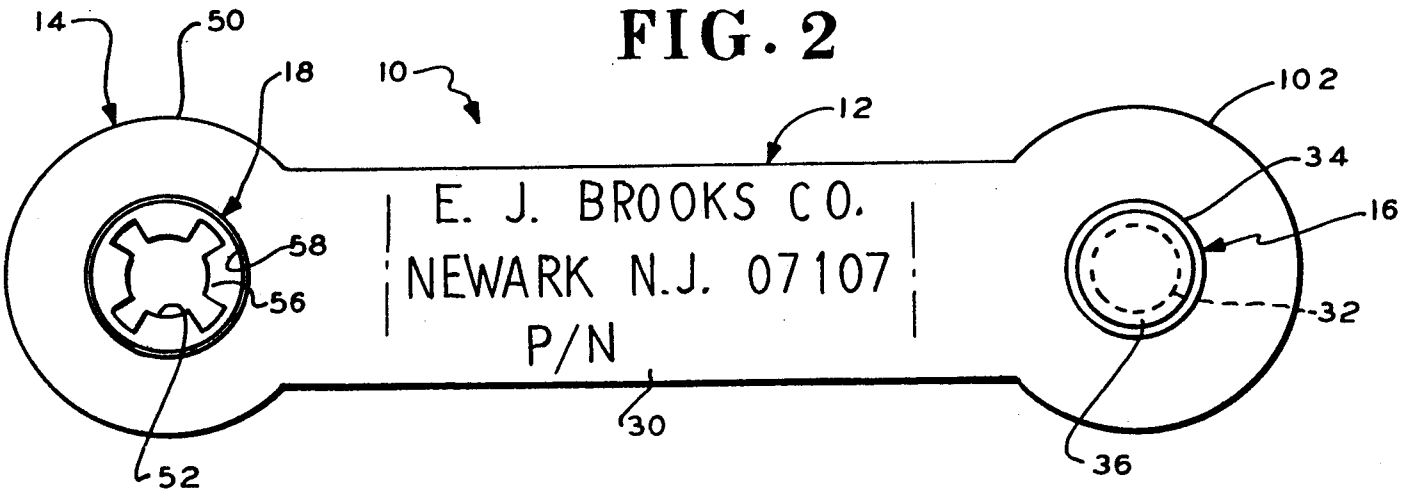

When the seal 10 is used with a barrel cover lock ring, the member is approximately 1.75 inches in length, although this dimension is obviously adjustable to suit other specific uses and environments. As shown in FIG. 2, one or both major surfaces of the member 30 may bear molded, imprinted or adhered indicia.

The locking portion 16 is carried at one end of the band 12. The locking portion 16 is a pin-like member 32 extending away from one surface of the member 30. Preferably, the member 32 extends perpendicularly away from the plane of the band 12. Also, preferably, the members 30 and 32 are integrally molded from the same material.

The member 32 includes an enlarged head 34 at its free end. The head 34 includes a forward camming surface 36 and a rearward shoulder 38. Near the conjunction of the members 30 and 32, the member 32 is enlarged, as shown at 40, for a purpose to be described below. Between the enlargement 40 and the member 30, the member 32 diminishes in size as shown at 41. On the opposite surface of the member 30 and generally coaxial with the member 32 may be an integral raised land area 42 for receiving identifying indicia by molding or printing.

In the specific embodiment hereof, the member 32 is 0.6 inch long with a diameter of about 0.12 inch. The diameter of the head 36 at the shoulder 38 is about 0.19 inch and the largest diameter of the enlargement 40 is about 0.16 inch.

The housing 14 is carried by the other end of the band 12 and is preferably integrally molded from the same material as the band 12. The housing 14 includes a generally cylindrical member 50 extending away from the other surface of the member 30. The member 50 is hollow and contains therewithin a plurality of resilient fingers 52 formed integrally with the member 50. The fingers 52 each have a free end 54 and normally occupy the positions shown in FIG. 1. The fingers 52 define a tapered passageway 56 running from an entry 58 into the interior of the member 50 to the free ends 54 of the fingers 52.

In the specific embodiment hereof, the housing 14 extends about 0.4 inch away from the band 30 and has an outside diameter of about 0.45 inch. The fingers 52 are four in number, are in excess of 0.1 inch long, and the defined passageway 56 has a diameter of about 0.2 inch at the entry 58 and about 0.11 inch at the free ends 54.

The relative sizes of the locking portion 16 and the housing 14 are selected so that the locking portion 16 is insertable into the housing 14. During such insertion, the camming surface 36 bears against the walls of the passageway 56 and flexes the fingers 52 outwardly to permit passage of the head 34 therethrough. This passage continues until the shoulder 38 clears the free ends 54 of the fingers 52 (see FIG. 5), whereat the fingers 52 resiliently return to their normal position with the free ends 54 moving inwardly. In their normal position, the free ends 54 abut the shoulder 38 preventing removal of the locking portion 16 from the passageway 56 without rendering the seal 10 disintegral. The member 32 of the locking portion 16 protrudes from the housing 14 as shown in FIG. 5. In the specific embodiment hereof, this protrusion is about 0.34 inch.

Figure 3:
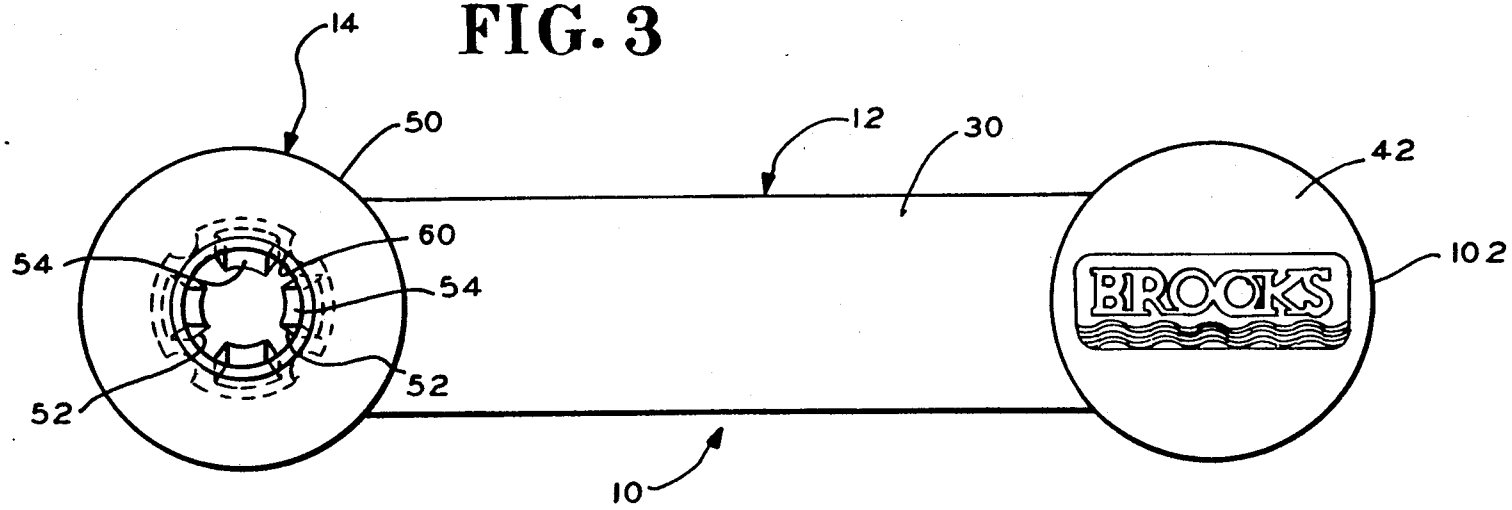
FIGS. 2 and 3 are, respectively, a front elevation and a rear elevation of the locking seal shown in FIG. 1.

As best seen in FIGS. 1, 3 and 5, the interior of the housing 14 opposite from the point of entry of the locking portion 16 is open, as at 60. This permits one-step molding of the seal 10. The head 34 is made sufficiently large to cover the free finger ends 54 to substantially fill the open interior of the housing 14 so that access to the fingers 52 cannot be gained through the opening 60.

Before the improvement of the present invention, the seal 10 would be used as follows. The locking portion 16 would be inserted through apertures 70 and 72 in the relatively movable members 20 and 22 of the container closure. The strap 12 (in the vicinity of the point of attachment 41 of the locking portion 16 thereto) and the housing 14 and areas of the strap 12 adjacent thereto maintain the locking portion 16 within the apertures 70 and 72 as shown in FIG. 5. Rightward movement of the locking portion 16 in the apertures 70 and 72 will ultimately cause engagement between the strap 12 and the member 20; leftward movement of the locking portion 16 will ultimately cause engagement between the strap 12 (or the housing 14) and the member 22. Given the intentional fragility of the seal 10, attempts to move the members 20 and 22 or to tamper with the seal 10 would result in its becoming disintegral. This same fragility, however, could also lead to accidental disintegrity of the seal 10. Specifically, during shipping, vibrations or oscillations imparted to the container, to the members 20 and 22 and to the seal 10 could ultimately result in the member 32 of the locking portion 16 being cut, sheared or sawn through by the surfaces and edges of the apertures 70 and 72, giving a false visual indication of tampering.

To obviate such false indications, the shroud 18 is provided. The shroud is integrally molded with, and made of the same frangible plastic as, the housing 14 and comprises a generally cylindrical, hollow, tubular projection 100 surrounding the entry 58 and extending away therefrom. The shroud 18 is sufficiently long to cover the majority of the locking portion 16 extending away from the housing 14 after the head 34 has been retained in the passageway 56. Preferably, the shroud 18 covers a portion of the enlargement 40. The ID of the shroud 18 and the OD of the enlargement 40 are sized to discourage insertion of an object between the two in an attempt to defeat the seal 10. This discouragement may be increased by enlarging the band 30, as shown at 102, at its point of connection to, and coaxially with, the pin-like member 32. This enlargement 102, which acts as a protective cover shielding the gap between the enlargement 40 and the shroud 18, may underlie the land area 42. Determined attempts to insert an object between the locking portion 16 and the shroud 18 will, because of the relative dimensions as illustrated in FIG. 5, result in rendering the enlargement 102, the locking portion 16, the shroud 18 and/or the point of attachment 41 between the locking portion 16 and the band 12 disintegral.

In the specific embodiment hereof, the shroud 18 is about 0.26 inch long, and has an OD of about 0.22 inch, an ID of about 0.2 inch, and a wall thickness of about 0.01 inch.

As shown in FIG. 5, the projection 100 of the shroud 18 is inserted through the apertures 70 and 72 of the members 20 and 22. The seal 10 is then assembled as described above, the locking portion 16 being inserted into the passageway 56 via the entry 58 by first moving it through the interior of the projection 100. As such, the shroud 18 is interposed between the walls and edges of the apertures 70 and 72 and the member 32. This interposition protects the member 32 against being cut or sheared by such walls and edges. As viewed in FIG. 5, the enlargement 102 and strap 12 to the left of the locking portion 16 and the housing 14 and strap 12 to the right of the locking portion 16 maintain the shroud 18 within the apertures 70 and 72.

The diminished area 41 of the member 32 serves as a weakened segment which enhances the fragility of the locking portion 16 to ensure that it fractures or breaks if tampering forces are applied to the seal 10.

As should be obvious the shroud 18 may take other configurations. The shroud 18 is positioned so as to protect against accidental cutting or shearing of the locking portion 16 and/or other portions of which is inserted into the container closure.

I claim:

1. An improved, frangible locking or security seal of the type which includes: a flexible band carrying at one end a housing and at the other end an elongated pin-like locking portion extending away from the band, the housing containing means for permitting insertion of a terminus of the locking portion thereinto while the remainder of the locking portion extends away from the housing, and for preventing withdrawal of the inserted locking portion terminus; the extending remainder of the locking portion being adapted to be located within apertures formed through relatively movable members of a closure, following which the locking portion terminus is inserted into the housing, the band and the housing maintaining the extending remainder of the locking portion within the apertures; attempts to tamper with or defeat the seal or to move the members of the closure resulting in the seal becoming disintegral to thereby give a visual indication of such attempts; the members of the closure and the seal undergoing vibratory or oscillatory motion during transportation and handling, which motion may result in disintegrity of the locking portion; wherein the improvement comprises:

a shroud adjacent the housing and surrounding both the point of insertion of the locking portion terminus into the housing and the majority of the extending remainder of the locking portion, the length of the shroud being slightly less than the distance, taken along the locking portion, between the two ends of the band when the locking portion terminus is held in the housing, the shroud being adapted to be interposed between the extending remainder of the locking portion and the walls and edges of the apertures in the closure members to prevent the locking portion from being cut or sheared by the vibratory or oscillatory motion.

2. A seal as in claim 1, wherein:

the band, the locking portion, the housing and the shroud are integrally formed from a frangible material.

3. A seal as in claim 2, wherein:

the seal is produced by molding a plastic material.

4. A seal as in claim 1, wherein:

the pin-like member is enlarged near its attachment to the band and is weakened at its point of attachment to the band, the enlargement being adapted to at least partially enter and reside sufficiently close to the interior of the shroud when the locking portion terminus is held in the housing the discourage attempts to insert objects between the pin-like member and the shroud, the weakening of the pin-like member ensuring that the seal becomes disintegral if tampering forces are applied thereto.

5. A seal as in claim 1, wherein:

the band is relatively planar, the locking portion is a pin-like member extending substantially perpendicularly away from a first side of the band, the housing extends substantially perpendicularly away from a second side of the band, and the shroud extends substantially perpendicularly away from the first side of the band.

6. A seal as in claim 5, wherein:

the band, the locking portion, the housing and the shroud are integrally formed from a frangible material.

7. A seal as in claim 6, wherein:

the seal is produced by molding a plastic material.

8. A seal as in claim 1, wherein:

the locking portion is a pin-like member mounted at one end to the band and having at the other end an enlarged head which has a forward camming surface and a rearward shoulder, and the insertion-permitting and withdrawal-preventing means includes a plurality of resilient fingers having free ends and defining therebetween a tapered passage;

insertion of the enlarged head into the tapered passageway resulting in the camming surface flexing the fingers outwardly to permit passage of the head therethrough until the shoulder clears the free ends of the fingers, whereupon the fingers resiliently return to their original positions and the free ends thereof abut the shoulder to prevent its withdrawal from the passageway.

9. A seal as in claim 8, wherein:

the housing is open at a location opposite the fingers, the head being sufficiently large to prevent access to the fingers when the shoulder has passed the free ends of the fingers.

10. A seal as in claim 9, wherein:

the band, the locking portion, the housing and the shroud are integrally formed from a frangible material.

11. A seal as in claim 10, wherein:

the seal is produced by molding a plastic material.

12. A seal as in claim 8, wherein:

the locking portion extends substantially perpendicularly away from the band, and the length of the shroud is slightly less than the distance, taken along the locking portion between the two ends of the band when the locking portion terminus is held in the housing.

13. A seal as in claim 12, wherein:

the locking portion is enlarged near its attachment to the band and is weakened at its attachment to the band, the enlargement being sufficiently close to the interior of the shroud when the locking portion terminus is held in the housing to discourage attempts to insert objects therebetween, the weakening of the locking portion ensuring that the seal becomes disintegral if tampering forces are applied thereto.

14. A seal as in claim 8, wherein:

the band is relatively planar, the locking portion extends substantially perpendicularly away from a first side of the band, the housing extends substantially perpendicularly away from a second side of the band, and the shroud extends substantially perpendicularly away from the first side of the band.

15. A seal as in claim 14, wherein:

the band, the locking portion, the housing and the shroud are integrally formed from a frangible material.

16. A seal as in claim 15, wherein:

the seal is produced by molding a plastic material.

* * * * *